US005117607A

United States Patent [19]

Bourdon

[11] Patent Number: 5,117,607

[45] Date of Patent: Jun. 2, 1992

[54] SECTIONAL HOLLOW METAL POLE STRUCTURE

[75] Inventor: Donald G. Bourdon, Brossard, Canada

[73] Assignee: Tri-Steel Industries Inc., Montreal, Canada

[21] Appl. No.: 780,382

[22] Filed: Oct. 23, 1991

Related U.S. Application Data

[63] Continuation of Ser. No. 532,679, Jun. 4, 1990, abandoned.

[51] Int. Cl.[5] ..... E04H 12/08

[52] U.S. Cl. ..... 52/731; 52/726; 52/297; 52/40

[58] Field of Search ..... 52/731, 726, 297, 40

[56] References Cited

U.S. PATENT DOCUMENTS

| | | | |
|---|---|---|---|
| 843,171 | 2/1907 | Petterson | 52/297 |
| 1,842,547 | 1/1932 | Hammel | 29/897.33 |
| 3,034,209 | 5/1962 | Bianca et al. | 52/726 |
| 3,378,978 | 4/1968 | Durand | 52/632 |
| 3,713,262 | 1/1973 | Jatcko | 52/726 |
| 4,248,025 | 2/1981 | Kleine et al. | 52/40 |

FOREIGN PATENT DOCUMENTS

| | | | |
|---|---|---|---|
| 362151 | 1/1906 | France | 52/726 |
| 635714 | 3/1928 | France | 52/297 |
| 667511 | 11/1928 | France | 52/297 |
| 69550 | 5/1914 | Switzerland | 52/726 |
| 298793 | 2/1954 | Switzerland | 52/726 |

*Primary Examiner*—David A. Scherbel
*Assistant Examiner*—Joanne C. Downs
*Attorney, Agent, or Firm*—Oblon, Spivak, McClelland, Maier & Neustadt

[57] ABSTRACT

A metal pole structure includes a plurality of elongated hollow pole sections interconnected end-to-end. Each section is formed with two or more elongated angled wall sections and a space extends longitudinally along each of the sections and the pole when assembled. Interconnecting diagonal braces extend across the longitudinal space. The braces interconnect with edge portions of wall sections on each side of the space to bridge the space to provide a structural wall section and to define access openings along the pole section to permit access to the interior of the hollow pole to effect the interconnection of the pole sections and the braces.

13 Claims, 3 Drawing Sheets

SECTIONAL HOLLOW METAL POLE STRUCTURE

This application is a continuation of application Ser. No. 07/532,679, filed on Jun. 4, 1990, now abandoned.

BACKGROUND OF INVENTION

1. Field of the Invention

The present invention relates to a metal pole structure which is comprised of a plurality of interconnected elongated hollow pole sections which define a longitudinal space therein with a plurality of braces connected across the space all along the pole with the space providing an access to effect interconnections between the pole sections and the braces.

2. Description of Prior Art

Various metal pole structures are known to provide various functions. The present metal pole structure was conceived particularly, but not exclusively, to replace wooden poles which are usually treated with a preservative in a bottom section thereof and embedded in the ground. A problem of these well known wooden poles is that they deteriorate over time as rot will set into the embedded portion of the pole. Also, the embedded portion contaminates the soil surrounding the pole due to the fact that these pole sections are treated with a preservative. Because of the preservative, there is also an environmental hazard when these poles are disposed of either by being burned or buried in the soil. Wooden poles also have limited applications and in certain geographical areas, it is not possible to utilize these poles because the ground may be too soft and swampy or the ground may be infested with termites which would destroy the poles. A still further disadvantage of these poles is that when utilizing them in a cable support application, it is necessary to have poles which are excessively long and heavy and this makes it difficult to transport the poles to the site and also to erect the poles. Such work is expensive, labor-intensive, and time-consuming. Still further, these poles are made by cutting large trees which results in a depletion of our forests.

SUMMARY OF INVENTION

It is a feature of the present invention to provide a novel metal pole structure which is intended to replace the well known wooden pole structures and which substantially overcomes all of the above-mentioned disadvantages of wooden poles.

Another feature of the present invention is to provide a novel metal pole structure which is competitive with known wooden poles.

Another feature of the present invention is to provide a metal pole structure which is comprised of a plurality of pole sections which are easy to transport and which may be assembled on site.

Another feature of the present invention is to provide a novel metal pole structure which can be embedded into the ground or in concrete, or secured to a base structure and which may be used for multiple applications.

According to the above features, from a broad aspect, the present invention provides a metal pole structure which is comprised of a plurality of elongated hollow pole sections interconnected end-to-end. Each section is provided with two or more elongated angled wall sections and a longitudinal space is provided in the section. Connecting means is provided to interconnect the pole sections end-to-end. Braces are interconnected with edge portions of the wall sections on each side of the space, to bridge the space to provide a bracing structure across the space and to define access openings along the pole sections to permit access to the interior of the hollow pole to effect interconnection of the pole sections and the braces.

BRIEF DESCRIPTION OF DRAWINGS

A preferred embodiment of the present invention will now be described with reference to the example thereof as illustrated in the accompanying drawings in which.

DESCRIPTION OF THE PREFERRED EMBODIMENTS

Figure 1:
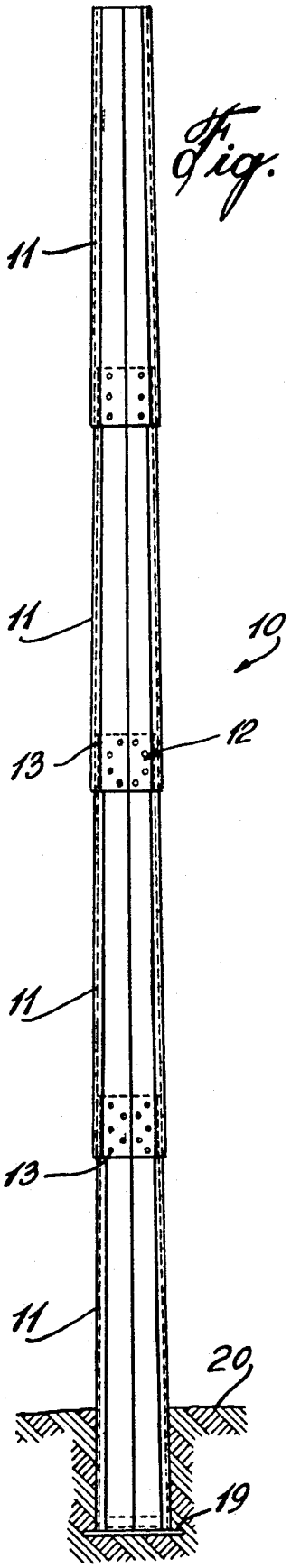
FIG. 1 is a side view illustrating a metal pole structure constructed in accordance with the present invention.
Figure 2:
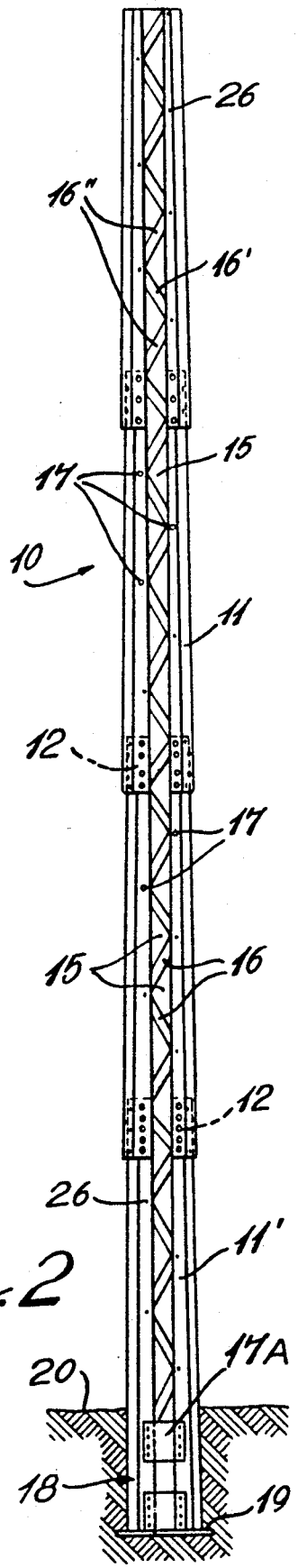
FIG. 2 is a view similar to FIG. 1 but illustrating the longitudinal space provided along the pole and the braces which are interconnected about the space and providing access to the interior of the pole.

Referring now to FIGS. 1 to 3, there is shown generally at 10, a metal pole structure constructed in accordance with the present invention and comprised of a plurality of elongated hollow pole sections 11 having outer surfaces thereof interconnected end-to-end. Each section 11 is provided with interconnecting means at the ends thereof to form the end interconnections 12 which are secured together by a plurality of fasteners 13, herein bolt fasteners.

Figure 3A:
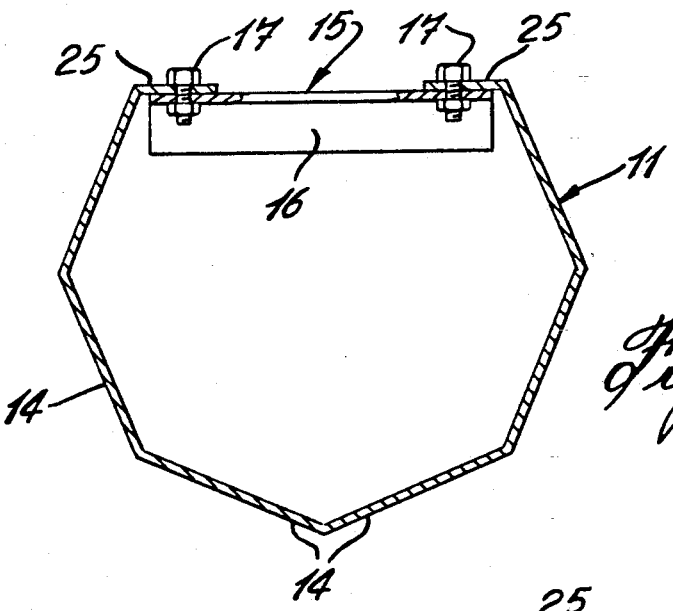
FIG. 3A is a cross-section of a pole section.
Figure 3B:
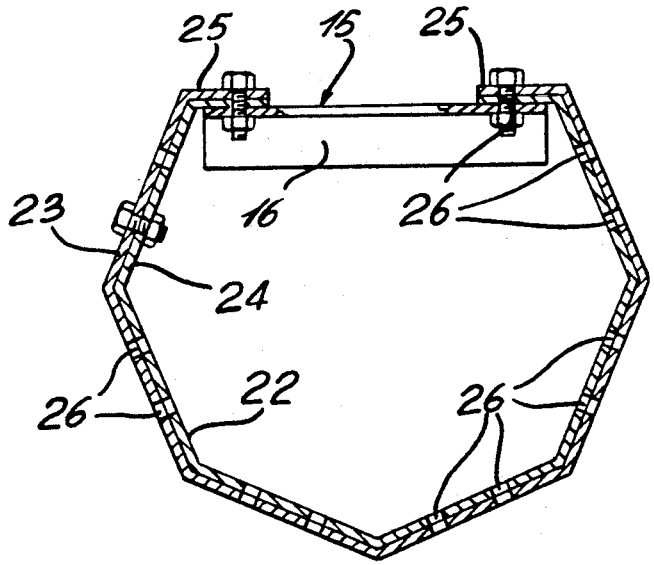
FIG. 3B is a further cross-section showing the manner in which the pole sections are connected end-to-end.

As can be seen from FIGS. 3A and 3B, each section 11 is a hollow pole section and defines at least two or more elongated angled wall sections 14 disposed at an angle to one another to provide structural rigidity. A space 15 is defined in a portion of the peripheral wall of each pole section and extends longitudinally thereof, here in entirely across the pole sections, from end-to-end.

As can be seen in FIG. 2, when these pole sections 11 are connected end-to-end, this space 16 extends all along the pole structure and a plurality of braces 16, herein a zig-zag array of diagonal braces, are connected across the space 15 all along the pole. These diagonal braces 15 are formed of angled straight metal struts interconnected at their opposed ends by bolt fasteners 17. The space 15 provides access openings in order to position and secure these bolt fasteners 17 and 13 to interconnect the pole sections end-to-end and the braces 16 all along the pole.

The braces 16 are, as mentioned hereinabove, connected diagonally in a zig-zag arrangement wherein when the pole structure 10 is subjected to a bending moment by wind or otherwise, one of the struts, for example strut 16', will be placed in tension while the adjacent braces 16'' will be subjected to compression, thereby providing a bracing structure across the space all along the pole. It is pointed out that it is within the ambit of the present invention to provide reinforcing braces of different shapes and, for example, a different type brace 17A is provided at the bottom connecting portion 18A of the pole. It is also conceivable that longitudinal space 15 may not extend from end-to-end.

Figure 4:
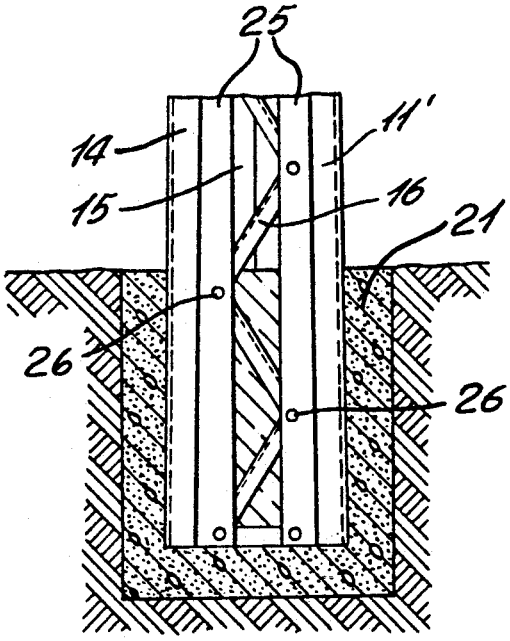
FIG. 4 is a side section view showing the bottom portion of the structural pole as secured in a concrete footing.

As shown in FIG. 1, the bottom connecting portion 17 may also be provided with a base plate 19 which is also bolted to the bottom end of the lower pole section 11' to constitute an anchoring means to stabilize the pole structure when anchored in the ground 20. The plate 19 could also be bolted to a support base structure, not shown. Alternatively, as shown in FIG. 4, the bottom pole section 11' need not be provided with a base plate if it is set in a concrete footing, such as shown at 21. When anchoring the bottom section 18 into the ground, as shown in FIG. 2, the embedded section is usually 10% of the height of the pole plus 2 feet below the ground surface whereby to provide excellent pole stability.

As is also shown in FIG. 1, the pole 10 tapers longitudinally from the bottom section thereof to the top section. This taper provides for the ends to mate one into the other to form the interconnection 12 between the pole sections. As herein shown, each pole section is provided with an upper tapered connecting portion 22 and a larger lower tapered connection portion 23 so that the upper connecting portion 22 of an adjacent pole section 11 can be received in close fit in the lower section 23. Each pole section is also progressively small in cross-section. A plurality of holes 26, 26 are provided in both sections 22 and 23 at predetermined locations whereby these holes will align with one another when the end sections are telescopically mated and bolt fasteners 13 are inserted in these holes through the spaces 15 provided in the slotted wall section of the pole.

After the pole sections 11 are assembled, the metal struts 16 are then interconnected. Of course, some of these struts 16 may be connected before the pole sections 11 are assembled and the struts in the end interconnection section 12 may be connected after the sections are assembled.

As can be seen more clearly in FIG. 3, the struts 16 are preferably disposed inside the hollow pole sections 11. However, as shown in FIG. 5C, these struts 16 may also be disposed on the outside of the pole structure. As shown in FIG. 3A, the edge portions 25 of the pole side walls, on each side of the opening 15, are formed as narrow wall sections and define connecting flanges on opposed sides of the space and are disposed in a common plane. A plurality of holes 26 are disposed at predetermined locations along these flanges to permit the interconnection of the struts 16 by the fasteners 17. The pole sections as illustrated in FIGS. 3A and 3B are comprised of six wall sections 14 of equal widths and this is a preferred cross-section for the assembly of a pole structure having a length of between 70 to 80 feet.

Figure 5A:
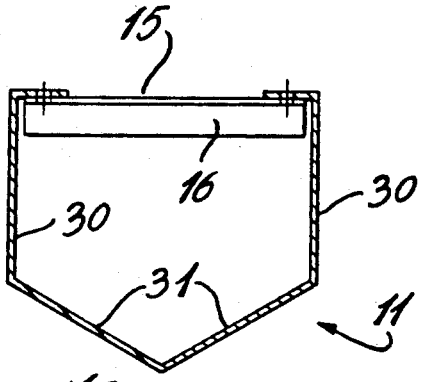
FIG. 5A is a cross-section of a pole section showing a variation thereof.

Referring to FIG. 5A, there is shown a pole structure having a different cross-section configuration and this is suitable when the pole height is shorter, say between 50 and 60 feet. As herein shown, the pole section 11 is comprised of four wall sections, two wall sections 30 which are disposed parallel to one another, and two other integrally formed wall sections 31 disposed on a common side of the parallel wall sections to form a pole section with a wall section of V-shaped cross-section.

Figure 5B:
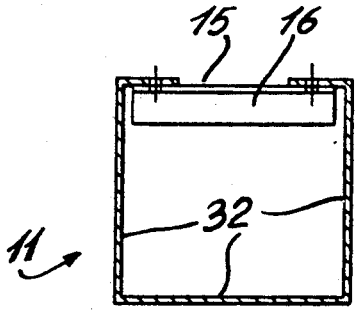
FIG. 5B is a cross-section of a pole section showing a further variation thereof.
Figure 5C:
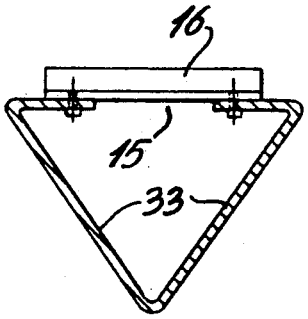
FIG. 5C is a cross-section of a pole section showing a still further variation thereof.

FIG. 5B shows a still further cross-section wherein the pole sections are rectangular and comprised of three equal width sections 32 disposed at right angles to one another.

FIG. 5C shows a still further embodiment wherein the pole section is of V-shaped cross-section and defined by two wall sections 33 disposed at an angle to one another and of substantially equal width. These latter cross-sections are for poles of heights shorter than 40 feet.

Figure 6:
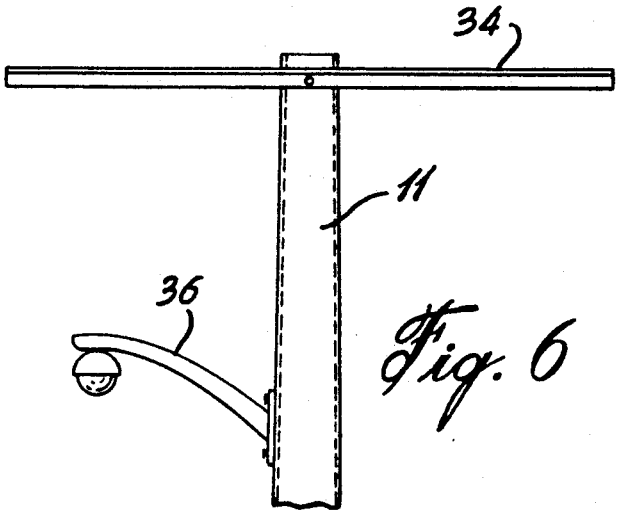
FIG. 6 is a side view of a top portion of the metal pole structure showing accessories connected thereto.
Figure 7:
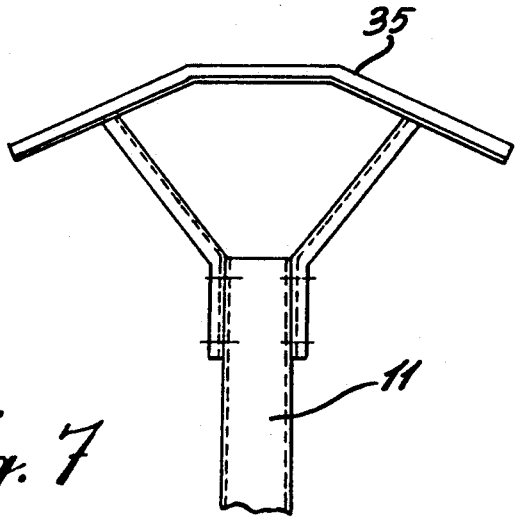
FIG. 7 is a view similar to FIG. 6 but showing an electrical line cross-arm assembly secured to the top end of the metal pole structure.

FIGS. 6 and 7 illustrate the connection of different accessories, such as a horizontal cross-arm 34 or a top cross-arm assembly 35 or a lamp 36 as connected at different locations along the pole structure. For these specific applications, holes would be provided at predetermined locations in predetermined pole sections to permit the interconnection of these accessories. Again, the interconnection would be made through the space 15 provided all along the pole. Many other accessories may be connected to the pole, along its length, as is obvious to a person skilled in the art. It would also be obvious to a person skilled in the art to provide end interconnections 12 which are different from those shown in the drawings and the pole sections 11 need not be tapered sections. It can be appreciated that a pole structure as defined herein provides for a very economical design in that it utilizes hollow metal sections which are easily transportable and easy to assemble. The interconnections are also made by bolt fasteners eliminating the need to provide welding, which is also more expensive and time-consuming. The pole is also easily dismantlable, easy to transport in a disassembled form, easy to erect, and has longevity as well as being able to be anchored in all types of soil surfaces and in areas of varying climatic conditions. Other various modifications of the preferred embodiment described herein are intended to be covered by the present application, provided such modifications fall within the scope of the appended claims.

I claim:

1. A metal pole structure, comprising:

a plurality of separate, elongated hollow pole sections having longitudinally interconnected end portions, each section being formed with at least two elongated angled wall sections and a longitudinal space provided between longitudinally extending edge portions thereof, an upper pole section of said pole sections having an upper tapered connecting portion and a larger lower tapered connecting portion so that an outer surface of a top portion of a lower pole section of said pole sections is received within and engages an inner surface of said lower connecting portion of said upper pole section, removable fastening means for interconnecting said top portion of said lower pole section with said lower connecting portion of said upper pole section, and a plurality of braces which interconnected said edge portions and bridge said space to provide a bracing structure that undergoes compression and tension alternatively when said pole is subjected to a bending moment, said space defining access openings along said pole sections to permit access to the interior of said hollow pole to effect interconnection of the pole sections and the braces.

2. A metal pole structure as claimed in claim 1 wherein said braces comprise straight metal struts disposed diagonally across said space and which are bolted at opposed ends thereof with said edge portions of said wall sections, said metal struts being disposed in a zigzag diagonal array along said plurality of interconnected pole sections.

3. A metal pole structure as claimed in claim 1 wherein each of said pole sections comprise elongated tapering sections which provide a tapered metal pole structure tapering from a base section to a top section thereof.

4. A metal pole structure as claimed in claim 1 wherein said fastening means are bolts extending through aligned holes provided in said connecting top and bottom portions.

5. A metal pole structure as claimed in claim 1 wherein there is further provided a base plate connected to a bottom end of a lowermost one of said interconnected pole sections to constitute anchoring means to stabilize said pole structure when anchored in the ground.

6. A metal pole structure as claimed in claim 1 wherein each of said pole sections comprises six wall sections of equal widths, said edge portions of said wall sections being narrow wall sections disposed on opposed sides of said space in a common plane and constituting connecting flanges for said metal braces.

7. A metal pole structure as claimed in claim 1 wherein each of said pole sections comprises three wall sections disposed at right angles to one another to define a pole structure of rectangular cross-section, said edge portions of said wall sections being narrow wall sections disposed on opposed sides of said space in a common plane and constituting connecting flanges for said metal braces.

8. A metal pole structure as claimed in claim 1 wherein each of said pole sections comprises four wall sections, two of said four wall sections being disposed parallel to one another, the other two wall sections being disposed on a common side of said parallel wall sections to form a pole section with a wall section of V-shaped cross-section, said edge portions of said wall sections being narrow wall sections disposed on opposed sides of said space in a common plane and constituting connecting flanges for said metal braces.

9. A metal pole structure as claimed in claim 1 wherein each of said pole sections comprises two angled wall sections which define a pole of triangular cross-section, said edge portions of said wall sections being narrow wall sections disposed on opposed sides of said space in a common plane and constituting connecting flanges for said metal braces.

10. A metal pole structure as claimed in claim 2 wherein said edge portions of said wall sections are narrow wall sections disposed on opposed sides of said space in a common plane and constituting connecting flanges for said metal braces.

11. A metal pole structure as claimed in claim 10 wherein said connecting flanges are provided with a plurality of spaced-apart connecting holes for receiving bolts therein to interconnect said diagonal struts to said flanges to bridge said space.

12. A metal pole structure as claimed in claim 10 wherein said metal braces are disposed inwardly of said pole and connected to an inner wall surface of said connecting flanges, said access openings providing hand access openings to permit the positioning and connection of bolts to connect said struts and said pole sections end-to-end.

13. A metal pole structure as claimed in claim 12 wherein predetermined sections of said structural pole are provided with predetermined holes to secure predetermined accessories to said assembled pole structure.

* * * * *